US011688963B2

(12) United States Patent
Herring et al.

(10) Patent No.: US 11,688,963 B2
(45) Date of Patent: Jun. 27, 2023

(54) CABLE SHIELD STRUCTURE FOR ELECTRICAL DEVICE

(71) Applicants: TE Connectivity Services GmbH, Schaffhausen (CH); Tyco Electronics Belgium EC BVBA, Oostkamp (BE)

(72) Inventors: Michael David Herring, Apex, NC (US); Bruce Allen Champion, Camp Hill, PA (US); Megha Shanbhag, Sunnyvale, CA (US); Lieven Decrock, Roeselare (BE)

(73) Assignees: TE CONNECTIVITY BELGIUM, Oostkamp (BE); TE CONNECTIVITY SOLUTIONS GmbH, Schaffhausen (CH)

( * ) Notice: Subject to any disclaimer, the term of this patent is extended or adjusted under 35 U.S.C. 154(b) by 0 days.

(21) Appl. No.: 17/330,846

(22) Filed: May 26, 2021

(65) Prior Publication Data

US 2022/0384971 A1 Dec. 1, 2022

(51) Int. Cl.
*H01R 12/75* (2011.01)
*H01R 13/6591* (2011.01)
*H01R 13/6596* (2011.01)

(52) U.S. Cl.
CPC ..... *H01R 12/75* (2013.01); *H01R 13/6596* (2013.01); *H01R 13/65912* (2020.08)

(58) Field of Classification Search
CPC ..... H01R 12/75; H01R 12/77; H01R 12/772; H01R 12/774; H01R 12/775; H01R 12/71; H01R 13/65912; H01R 13/6596; H01R 13/65914; H01R 13/65917; H01R 13/65918; H01R 13/6591; H01R 13/6594; H01R 13/6593
See application file for complete search history.

(56) References Cited

U.S. PATENT DOCUMENTS

| | | | | |
|---|---|---|---|---|
| 8,840,432 | B2 | 9/2014 | Alden, III et al. | |
| 9,011,177 | B2 * | 4/2015 | Lloyd | H01R 13/6471 439/607.47 |
| 9,124,009 | B2 * | 9/2015 | Atkinson | H01R 13/65914 |
| 9,203,193 | B2 * | 12/2015 | Hackman | H01R 12/62 |
| 9,437,949 | B2 | 9/2016 | Behziz et al. | |
| 10,170,862 | B2 * | 1/2019 | Weidner | H01R 13/652 |
| 10,367,294 | B1 * | 7/2019 | Smith | H01R 12/69 |
| 2010/0210142 | A1 * | 8/2010 | McGrath | H01R 13/6474 439/620.22 |
| 2011/0306244 | A1 * | 12/2011 | Zhang | H01R 13/65914 439/624 |
| 2018/0287280 | A1 * | 10/2018 | Ratkovic | H01R 12/62 |
| 2020/0366017 | A1 * | 11/2020 | Blackburn | H01R 13/6587 |
| 2020/0395717 | A1 * | 12/2020 | Kim | H01R 12/775 |

* cited by examiner

*Primary Examiner* — Harshad C Patel

(57) ABSTRACT

A cable shield tunnel for an electrical device includes a ground bus and a floor shim, discrete from the ground bus, and coupled to a circuit card and forming a cable tunnel that receives an end of a cable. The ground bus includes an end wall extending along a first end of the cable tunnel, a first side wall extending from the end wall along a first side of the cable tunnel, and a second side wall extending from the end wall along a second side of the cable tunnel opposite the first side. The first and second side walls are configured to be coupled to the circuit card. The floor shim is provided at a second end of the cable tunnel opposite the first end and is positioned between the cable and the circuit card.

20 Claims, 5 Drawing Sheets

CABLE SHIELD STRUCTURE FOR ELECTRICAL DEVICE

BACKGROUND OF THE INVENTION

The subject matter herein relates generally to electrical devices.

Various types of electrical devices may include circuit boards that are electrically coupled to differential pairs of signal conductors or, more specifically, pairs of signal conductors that transmit differential signals. The signal conductor(s) are surrounded by a shield layer that, in turn, is surrounded by a cable jacket. At an end of the communication cable, the cable jacket, the shield layer, and insulation that covers the signal conductor(s) may be removed (e.g., stripped) to expose the signal conductor(s). The exposed portions of the conductor(s) may then be mechanically and electrically coupled (e.g., soldered) to contacts or a circuit card of an electrical device. However, signal integrity of the signal conductors is diminished at the transition area between the cable core and the circuit card.

Accordingly, there is a need for an electrical device that provides simple and reliable shielding at the termination between the signal conductors and the circuit card.

BRIEF DESCRIPTION OF THE INVENTION

In one embodiment, a cable shield tunnel is provided for an electrical device that includes a ground bus and a floor shim configured to be coupled to a circuit card. The ground bus and the floor shim form a cable tunnel configured to receive an end of a cable. The ground bus includes an end wall extending along a first end of the cable tunnel, a first side wall extending from the end wall along a first side of the cable tunnel, and a second side wall extending from the end wall along a second side of the cable tunnel opposite the first side. The first and second side walls are configured to be coupled to the circuit card. The floor shim is discrete from the ground bus. The floor shim is separately coupled to the circuit card. The floor shim is provided at a second end of the cable tunnel opposite the first end. The floor shim is configured to be positioned between the cable and the circuit card.

In another embodiment, an electrical device is provided including a circuit card having cable contacts along a mounting surface at a cable end and a cable terminated to the mounting surface of the circuit card at the cable end. The cable has an inner signal conductor terminated to the corresponding cable contact and an outer conductor providing electrical shielding for the inner signal conductor. A cable shield tunnel is coupled to the circuit card at the mounting surface. The cable shield tunnel includes a ground bus and a floor shim coupled to a circuit card. The ground bus and the floor shim form a cable tunnel receive the end of the cable. The ground bus includes an end wall extending along a first end of the cable tunnel, a first side wall extending from the end wall along a first side of the cable tunnel, and a second side wall extending from the end wall along a second side of the cable tunnel opposite the first side. The first and second side walls are configured to be coupled to the circuit card. the floor shim is discrete from the ground bus. The floor shim is separately coupled to the circuit card. The floor shim is provided at a second end of the cable tunnel opposite the first end. The floor shim is configured to be positioned between the cable and the circuit card.

In a further embodiment, an electrical device is provided including a circuit card having cable contacts along a mounting surface at a cable end and a cable terminated to the mounting surface of the circuit card at the cable end. The cable has an inner signal conductor terminated to the corresponding cable contact and an outer conductor providing electrical shielding for the inner signal conductor. The end of the cable has a cable height. A cable shield tunnel is coupled to the circuit card at the mounting surface. The cable shield tunnel includes a ground bus and a floor shim coupled to a circuit card. The ground bus and the floor shim form a cable tunnel receive the end of the cable. The ground bus includes an end wall extending along a first end of the cable tunnel, a first side wall extending from the end wall along a first side of the cable tunnel, and a second side wall extending from the end wall along a second side of the cable tunnel opposite the first side. The first and second side walls are configured to be coupled to the circuit card. the floor shim is discrete from the ground bus. The floor shim is separately coupled to the circuit card. The floor shim is provided at a second end of the cable tunnel opposite the first end. The floor shim is configured to be positioned between the cable and the circuit card. The floor shim has a thickness selected based on the tunnel height and the cable height.

DETAILED DESCRIPTION OF THE INVENTION

Embodiments described herein include electrical devices (e.g., electrical connectors, circuit board assemblies, and the like) that have a circuit board and cables terminated to the circuit board. The cables may have differential pairs of signal conductors and an outer conductor or shield layer providing shielding for the signal conductors. A cable jacket surrounds the shield layer and has an access opening that exposes the shield layer for electrical connection to a ground bus, which provides electrical shielding for the signal conductors at the end of the cable. Embodiments described herein include a floor shim that provides electrical shielding for the cable. The floor shim positions the cable relative to the ground bus to improve electrical performance. For example, the floor shim may be designed for impedance control of the signal conductors at the end of the cable.

Figure 1:
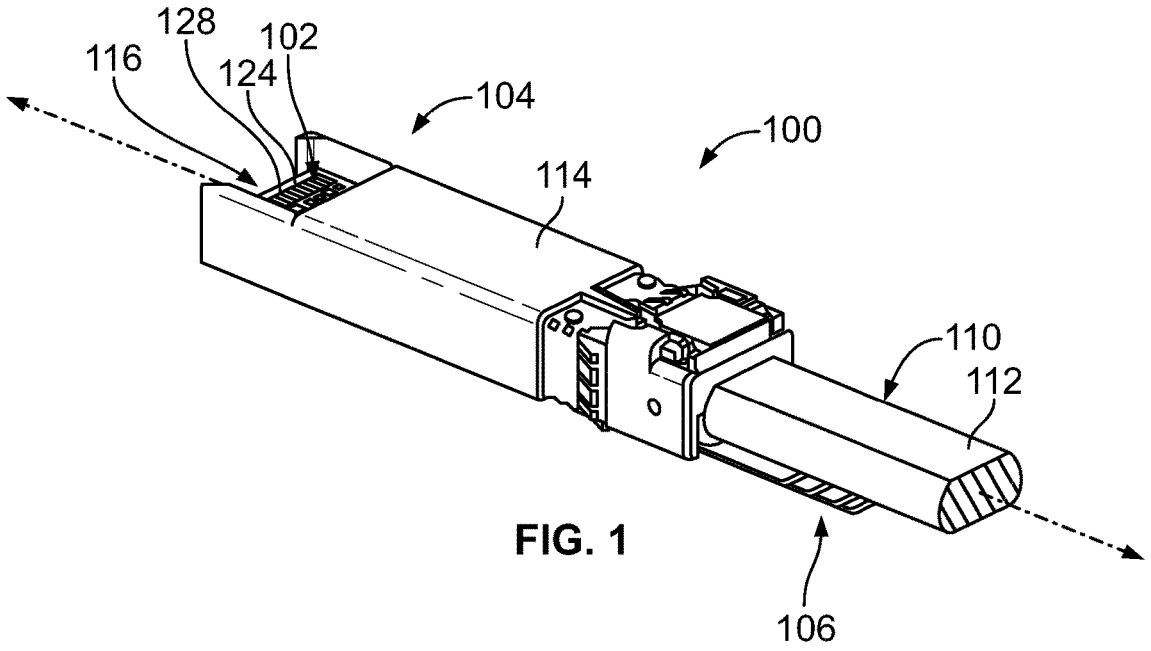
FIG. 1 is a perspective view of an electrical device formed in accordance with an exemplary embodiment.

FIG. 1 is a perspective view of an electrical device 100 formed in accordance with an exemplary embodiment. The electrical device 100 includes a circuit card 102 and one or more communication cables 110 terminated to the circuit card 102. In the illustrated embodiment, the electrical device 100 is an electrical connector, such as a small form-factor pluggable (SFP) transceiver. However, the electrical device 100 may be another type of electrical connector in an alternative embodiment. For example, the electrical device 100 may be any device that includes a circuit board.

The electrical device 100 has a mating end 104 and a cable end 106 opposite the mating end 104. The mating end 104 is configured to be plugged into a mating electrical device, such as a receptacle (not shown) of a communication system. The cable 110 extends from the cable end 106. The cable 110 has an insulative jacket 112 that surrounds one or more differential pairs of signal conductors and a shield layer. The insulative jacket 112 provides strain resistance and protection from the surrounding environment for the communication cable 110. The jacket 112 may include, for example, polyvinyl chloride (PVC), aluminized Polyethylene Terephthalate (PET), and/or shield tape.

The electrical device 100 includes a device housing 114 that has a housing cavity 116 that receives the circuit card 102. The cable 110 extends into the housing cavity 116. The circuit card 102 has electrical contacts 124 located at a mating edge 128 of the circuit card 102. In an exemplary embodiment, the mating edge 128 is configured to mate with a mating electrical connector (not shown) of the receptacle and establish a communicative connection through the electrical contacts 124. The electrical contacts 124 may be communicatively coupled to the signal conductors of the cable 110.

Figure 2:
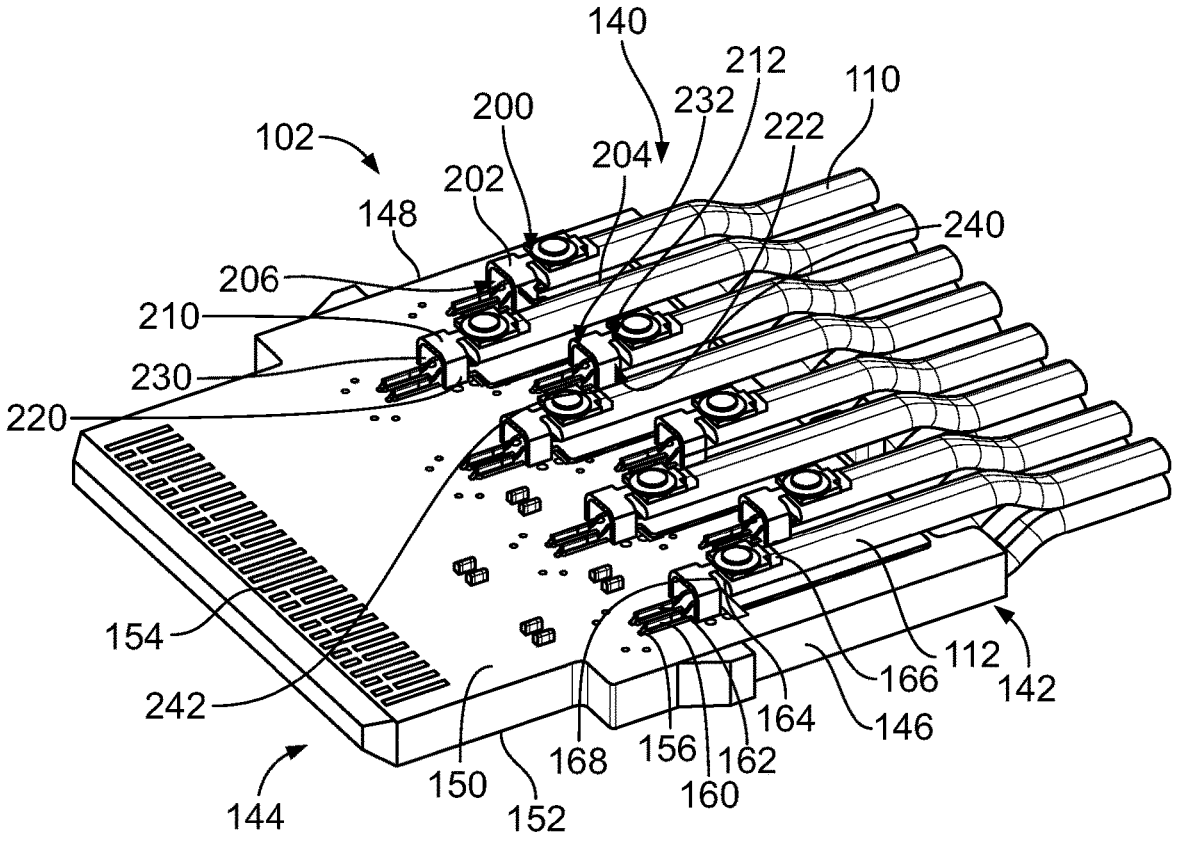
FIG. 2 is a top perspective view of an electrical assembly in accordance with an exemplary embodiment that may be used with the electrical device of FIG. 1.

FIG. 2 is a top perspective view of an electrical assembly 140 in accordance with an exemplary embodiment that may be used with the electrical device 100 of FIG. 1. The electrical assembly 140 may be disposed at least partially within the device housing 114 (shown in FIG. 1). The electrical assembly 140 includes the circuit card 102 and the cables 110 terminated to the circuit card 102. In an exemplary embodiment, the electrical assembly 140 includes cable shield tunnels 200 coupled to the circuit card 102. The cable shield tunnels 200 electrically connect the cables 110 to the circuit card 102. The cable shield tunnels 200 provide electrical shielding for the cables 110 at the interfaces between the cables 110 and the circuit card 102.

The circuit card 102 has a cable end 142, a mating end 144, and side edges 146, 148 extending between the cable end 142 and the mating end 144. The circuit card 102 includes an upper surface 150 and a lower surface 152. In an exemplary embodiment, the cables 110 are terminated to the circuit card 102 at the cable end 142 at both the upper surface 150 and the lower surface 152. However, the cables 110 may be terminated to only the upper surface 150 or the lower surface 152. The circuit card 102 may include a number of dielectric layers (e.g., FR-4 layers), traces, vias, and ground planes. The circuit card 102 includes mating contacts 154 at the mating end 144 for mating with the mating electrical connector. For example, the mating end 144 may be plugged into a card slot of the mating electrical connector. The circuit card 102 includes cable contacts 156 rearward of the mating contacts 154 (such as closer to the cable end 142). Optionally, the cable contacts 156 may be located closer to the cable end 142 than the mating end 144. The signal conductors of the cables 110 are terminated to corresponding cable contacts 156. In the illustrated embodiment, the contacts 154, 156 are contact pads and may include signal and ground contacts. The contacts 154, 156 may be communicatively coupled to one another through the circuit card 102. For example, the traces (not shown) of the circuit card 102 may communicatively couple the contacts 154, 156.

In the illustrated embodiment, the cables 110 are terminated to the circuit card 102 at the cable end 142. For example, eight cables 110 may be connected at the upper surface 150 (for example, in two rows) and eight cables 110 may be connected to the lower surface 152. In some embodiments, the cables 110 may be characterized as twin-axial or parallel-pair cables. In parallel-pair configurations, the cables 110 include differential pairs of signal conductors 160, 162 held by an insulator 164. An outer conductor 166, or shield layer, surrounds the insulator along the length of the cable 110 to provide electrical shielding for the signal conductors 160, 162. The outer conductor may be a braided shield, a foil wrap, or another type of shield layer. The jacket 112 of the cable 110 surrounds the outer conductor 166 to protect the outer conductor 166. The signal conductors 160, 162 of a single differential pair extend parallel to each other through the length of the cable 110. The external jacket 112, the outer conductor 166 and the insulator 164 are stripped at an end 168 of the cable 110. The signal conductors 160, 162 extend forward of the end of the insulator 164 and the outer conductor 166 at the end 168 of the cable 110. The exposed ends of the signal conductors 160, 162 are configured to be terminated to the cable contacts 156, such as by soldering to the cable contacts 156. In alternative embodiments, the signal conductors 160, 162 within the cable 110 may form a twisted pair of signal conductors. In other various embodiments, the communication cable 110 may be a single-ended cable having a single central conductor rather than the pair of signal conductors.

Each cable shield tunnel 200 includes a ground bus 202 and a floor shim 204, both of which are configured to be coupled to the circuit card 102. The ground bus 202 and the floor shim 204 form a cable tunnel 206 configured to receive the end 168 of the cable 110. The cable shield tunnel 200 is electrically connected to the circuit card 102 and is electrically connected to the outer conductor 166. For example, the cable shield tunnel 200 may be soldered to the circuit card 102 and soldered to the outer conductor 166.

In an exemplary embodiment, the cable shield tunnel 200 surrounds the cable 110 on all four sides (for example, top, bottom, right, left). In an exemplary embodiment, the cable shield tunnel 200 is provided at the end 168 of the cable 110 and at the termination to the circuit card 102. For example, the cable shield tunnel 200 extends both forward of and rearward of the end 168. The cable shield tunnel 200 extends along portions of both the exposed ends of the signal conductors 160, 162 and extends along a portion of the outer conductor 166. The cable shield tunnel 200 provides electrical shielding for the exposed portions of the signal conductors 160, 162 as the signal conductors 160, 162 transition from the end of the insulator 164 to the cable contacts 156.

The ground bus 202 (also shown in further detail in FIGS. 6 and 7) is a stamped and formed part formed from a metal blank or plate. The ground bus 202 includes an end wall 210 extending along a first end 212 of the cable tunnel 206, a first side wall 220 extending from the end wall 210 along a first side 222 of the cable tunnel 206, and a second side wall 230 extending from the end wall 210 along a second side 232 of the cable tunnel 206 opposite the first side 222. The end wall 210 is coupled to the outer conductor 166. For example, the end wall 210 includes a solder tab 214 extending along and soldered to the outer conductor 166. The first and second side walls 220, 230 are coupled to the circuit card 102. For example, the side walls 220, 230 may include solder tails or press fit pins configured to be terminated to the circuit card 102.

The floor shim 204 (also shown in further detail in FIGS. 3 and 4) is a stamped and formed part formed from a metal blank or plate. The floor shim 204 is separate and discrete from the ground bus 202. The floor shim 204 is separately coupled to the circuit card 102 from the ground bus 202. The floor shim 204 includes a plate 240 provided at a second end 242 of the cable tunnel 206 opposite the first end 212. For example, the floor shim 204 may be positioned at a bottom of the cable tunnel 206 and the end wall 210 may be positioned at a top of the cable tunnel 206 (however, the cable shield tunnels 200 on the lower side of the circuit card 102 have an opposite orientation). The floor shim 204 is configured to be positioned between the cable 110 and the circuit card 102. The floor shim 204 provides electrical shielding. In an exemplary embodiment, the floor shim 204 is used to position the cable 110 relative to the ground bus 202. For example, the floor shim 204 positions the cable 110 in the cable tunnel 206. The floor shim 204 elevates the cable 110 off of the circuit card 102 to position the cable 110 in the cable tunnel 206, such as for mating with the solder tab 214 of the end wall 210. The thickness of the floor shim 204 may be selected based on the size of the cable and the location (for example, height) of the solder tab 214 to correctly position the cable 110 for soldering to the solder tab 214.

Figure 3:
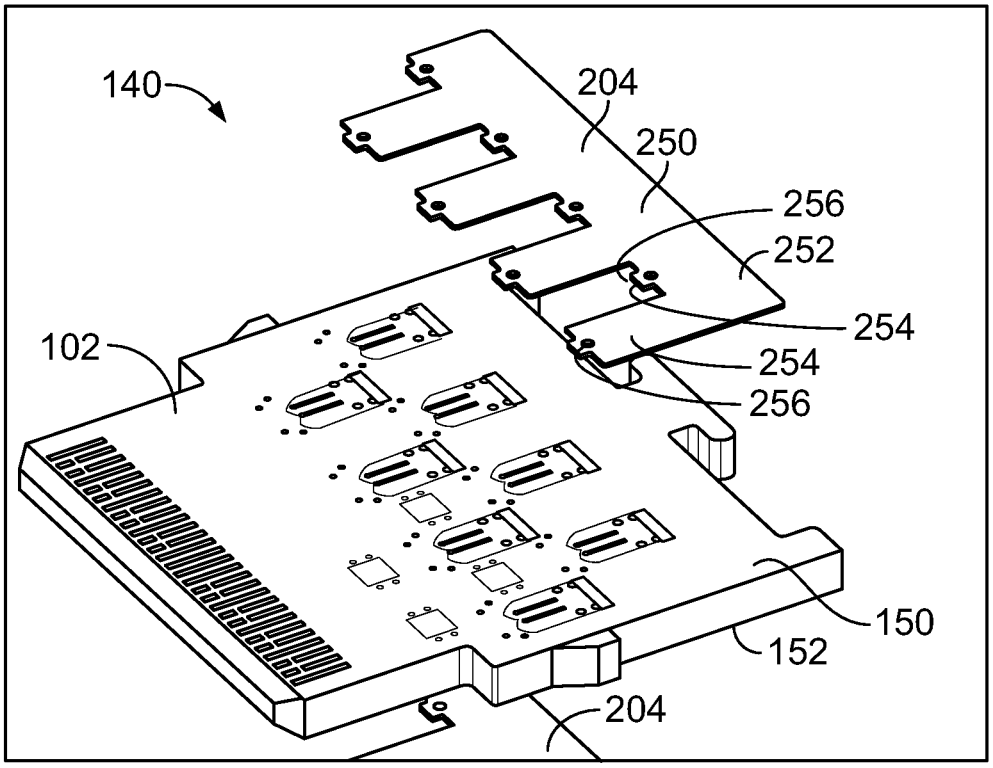
FIG. 3 is an exploded view of a portion of the electrical assembly in accordance with an exemplary embodiment showing a circuit card and cable shield tunnel.
Figure 4:
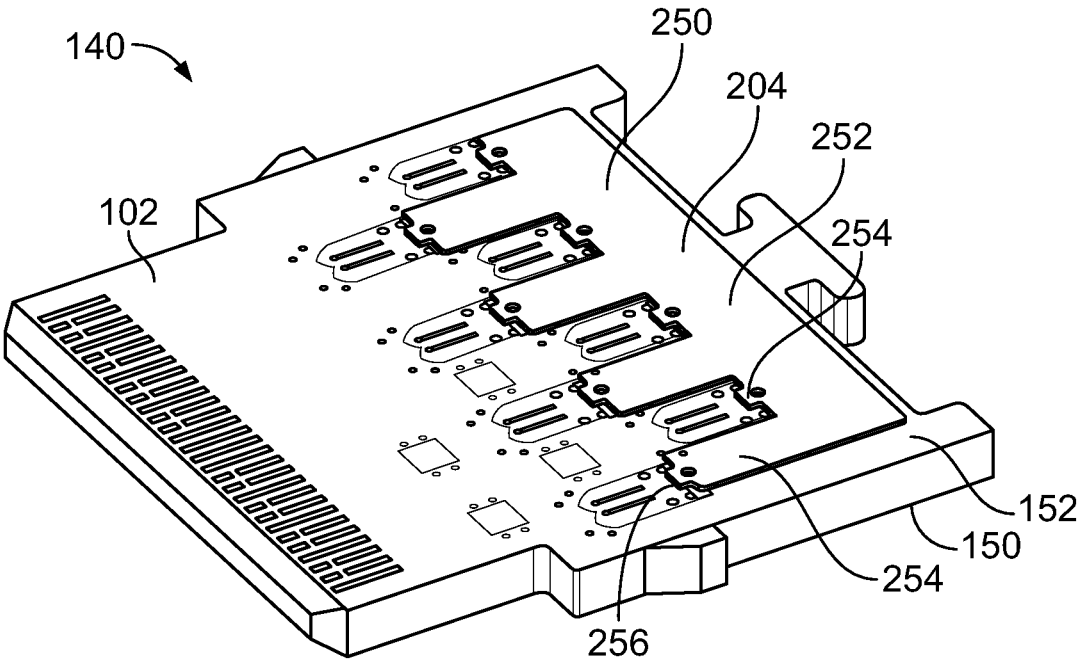
FIG. 4 is a bottom perspective view of a portion of the electrical assembly in accordance with an exemplary embodiment.

FIG. 3 is an exploded view of a portion of the electrical assembly 140 in accordance with an exemplary embodiment showing the circuit card 102 and the floor shims 204 of the cable shield tunnel 200. FIG. 4 is a bottom perspective view of a portion of the electrical assembly 140 in accordance with an exemplary embodiment showing the bottom of the circuit card 102 and the corresponding floor shim 204 of the cable shield tunnel 200. In the illustrated embodiment, the floor shims 204 include a single floor shim for the upper surface 150 of the circuit card 102 and a single floor shim for the lower surface 152 of the circuit card 102. However, in alternative embodiments, multiple floor shims may be provided for the upper surface 150 and similarly for the lower surface 152. For example, a separate floor shim 204 may be provided for each cable 110 (shown in FIG. 2).

The floor shim 204 includes a plate 250 having a base portion 252 and extensions 254 extending forward of the base portion 252. The base portion 252 electrically connects each of the extensions 254. Each extension 254 is configured to support a corresponding cable 110. In the illustrated embodiment, the extensions 254 have different lengths such that distal ends 256 of the extensions 254 are provided at different forward positions. For example, the distal ends 256 may be arranged in two rows, such as a forward row and a rearward row. In an exemplary embodiment, the floor shim 204 is generally planar. The floor shim 204 is configured to be electrically connected to the circuit card 102. For example, the floor shim 204 may be soldered corresponding circuits of the circuit card 102. For example, the floor shim 204 may be soldered to a ground plane of the circuit card 102. The floor shim 204 may be soldered to ground contact pads of the circuit card 102. The floor shim 204 may be mechanically and electrically connected to the circuit card 102 by other processes in alternative embodiments, such as being press-fit into plated vias of the circuit card 102 using press-fit pins extending from the plate 250.

Figure 5:
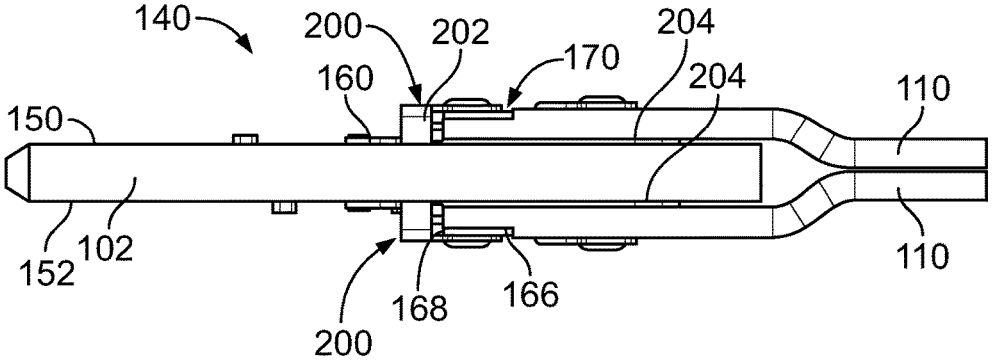
FIG. 5 is a side view of a portion of the electrical assembly in accordance with an exemplary embodiment showing the cables and the cable shield tunnels terminated to the circuit card.
Figure 6:
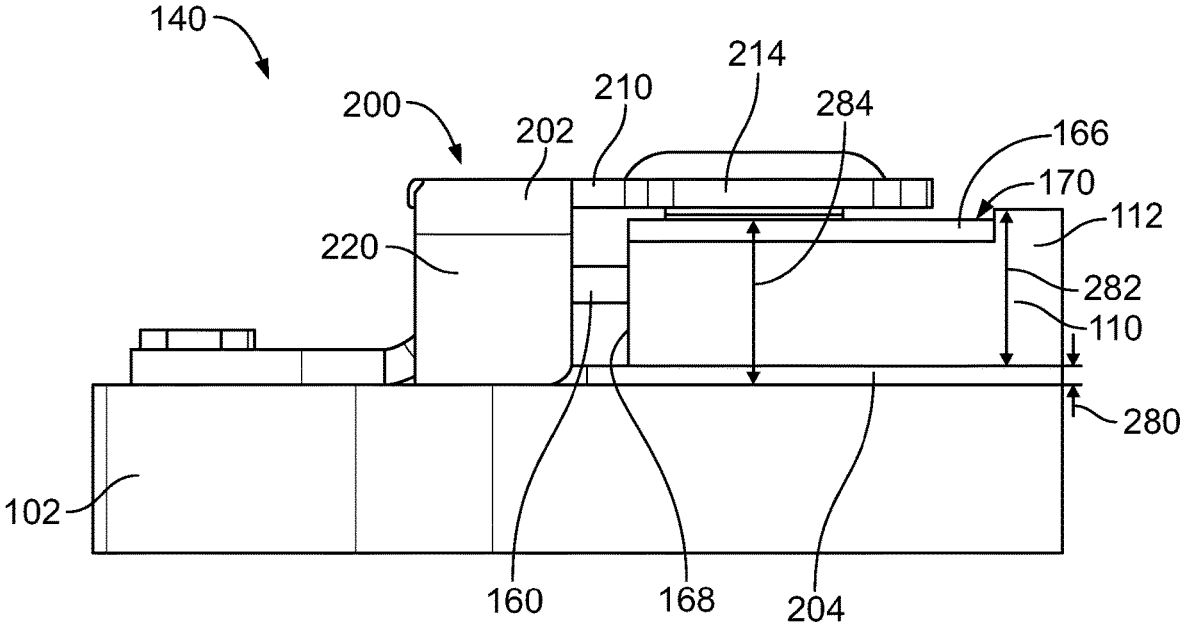
FIG. 6 is an enlarged side view of a portion of the electrical assembly in accordance with an exemplary embodiment showing the cable and the corresponding cable shield tunnel terminated to the circuit card.

FIG. 5 is a side view of a portion of the electrical assembly 140 in accordance with an exemplary embodiment showing the cables 110 and the cable shield tunnels 200 terminated to the circuit card 102. FIG. 6 is an enlarged view of a portion of the electrical assembly 140 in accordance with an exemplary embodiment showing the cable 110 and the corresponding cable shield tunnel 200 terminated to the circuit card 102. In the illustrated embodiment, the cables 110 and the cable shield tunnels 200 are provided at both the upper surface 150 and the lower surface 152.

The cables 110 are prepared by stripping the insulator 164, the outer conductor 166, and the outer jacket 112 from the end 168 of the cable 110. In an exemplary embodiment, a portion of the outer jacket 112 is removed to form a window 170 that exposes a length of the outer conductor 166 for electrical connection with the solder tab 214. For example, the window 170 may be provided at the top of the cable 110 for connection with the solder tab 214. The signal conductors 160, 162 extend forward of the end 168 of the cable 110. The exposed portions of the signal conductors 160, 162 may be soldered to the circuit card 102.

Figure 7:
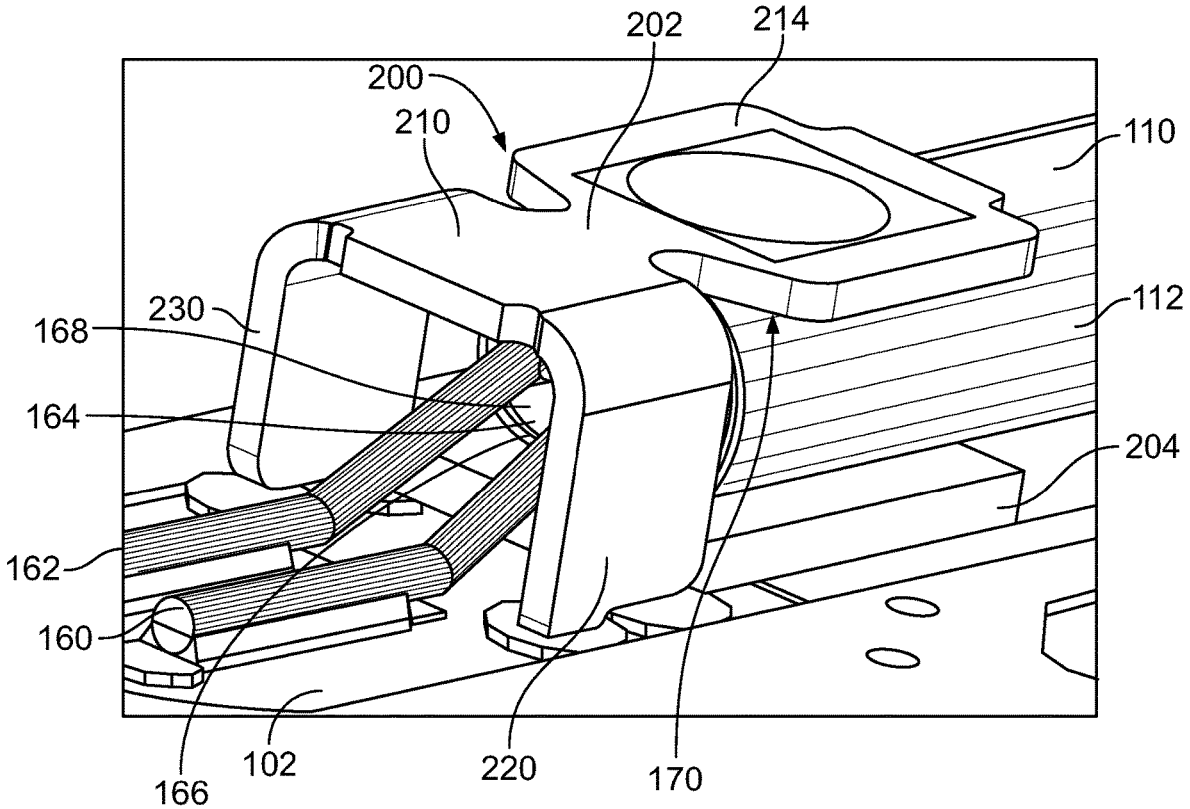
FIG. 7 is a perspective view of a portion of the electrical assembly in accordance with an exemplary embodiment showing the cable and the corresponding cable shield tunnel terminated to the circuit card.

With additional reference to FIG. 7, which is a perspective view of a portion of the electrical assembly 140 in accordance with an exemplary embodiment showing the cable 110 and the corresponding cable shield tunnel 200 terminated to the circuit card 102, the cable shield tunnels 200 provide electrical shielding for the signal conductors 160, 162 as the signal conductors 160, 162 transition from the end 168 of the cable 110 to the circuit card 102. In an exemplary embodiment, the cable shield tunnels 200 provide impedance control to enhance electrical performance of the cables 110. For example, spacing and positioning between the structures of the cable shield tunnel 200 and the signal conductors 160, 162 affect the impedance and cross talk for the signal transmission lines. Optionally, portions of the signal conductors 160, 162 may extend forward of the cable shield tunnels 200. For example, the portions of the signal conductors 160, 162 that are soldered to the cable contacts are located forward of the cable shield tunnels 200. In alternative embodiments, the cable shield tunnels 200 may have extended lengths to provide shielding along the entire lengths of the signal conductors 160, 162 (exterior to the insulator). For example, the side walls 220, 230 may be extended in alternative embodiments.

In an exemplary embodiment, the side walls 220, 230 (FIG. 7) are positioned forward of the end 168 of the cable 110. The side walls 220, 230 provide shielding for the exposed portions of the signal conductors 160, 162. Optionally, the side walls 220, 230 may additionally extend rearward of the end 168 of the cable 110 to provide additional shielding. In an exemplary embodiment, the end wall 210 is positioned both forward of the end 168 of the cable 110 and rearward of the end 168 of the cable 110. For example, a front portion of the end wall 210 is located between the side walls 220, 230. A rear portion of the end wall 210 forms the solder tab 214 and extends along the exposed portion of the outer conductor 166 at the window 170. The solder tab 214 is soldered to the outer conductor 166 through the window 170.

In an exemplary embodiment, the floor shim 204 is positioned rearward of the end 168 of the cable 110. The floor shim 204 extends along a length of the cable 110. The floor shim 204 is located between the cable 110 and the circuit card 102. The floor shim 204 elevates the cable 110 at a position or height above the surface of the circuit card 102. The thickness of the floor shim 204 controls the elevated position of the cable 110. In an exemplary embodiment, the floor shim 204 extends forward of the end 168 of the cable 110. For example, the floor shim 204 may extend along portions of the exposed signal conductors 160, 162 to provide shielding between the exposed signal conductors 160, 162 and the circuit card 102. The positioning of the floor shim 204 relative to the exposed signal conductors 160, 162 affects signal integrity, such as by lowering impedance of the signal transmission lines. Optionally, the floor shim 204 may extend into the space between the side walls 220, 230. The floor shim 204 may contact and thus electrically connect to the ground bus 202. Optionally, the floor shim 204 may engage the side walls 220, 230 by an interference fit or by using commoning features, such as slots, tabs, pins, and the like. The floor shim 204 may be soldered to the side walls 220, 230.

The floor shim 204 has a thickness 280 shown, for example, in FIG. 6. The thickness 280 may be defined by the thickness of the blank or sheet of metal from which the floor shim 204 is stamped. Different metal sheet having different thicknesses may be used to provide floor shims having different thicknesses 280. The thickness 280 of the floor shim 204 is used to control the spacing or amount of elevation of the cable 110 from the surface of the circuit card 102. For example, using a thicker floor shim 204 elevates the cable 110 at a greater height, whereas using a thinner floor shim 204 positions the cable 110 closer to the surface of the circuit card 102. The thickness 280 is selected based on the size of the cable 110 and the position of the solder tab 214 relative to the surface of the circuit card 102. For example, the cable 110 may have a cable height 282. The interior surface of the solder tab 214 is located at a tunnel height 284 (illustrated in FIG. 6) from the surface of the circuit card 102. The thickness 280 is selected to position the outer conductor 166 at the interior surface of the solder tab 214. Thicker floor shims 204 may be used with smaller cables, whereas thinner floor shims 204 may be used with larger cables. The floor shim 204 additionally controls the location of the signal conductors 160, 162 relative to the end wall 210 of the ground bus 202. For example, the floor shim 204 elevates the exit location of the signal conductors 160, 162, thus positioning the signal conductors 160, 162 closer to the end wall 210, which affects signal characteristics, such as impedance. In an exemplary embodiment, different size cables 110 may be terminated to the circuit card 102 using the same ground bus 202 by selective use of the floor shim 204. For example, different size floor shims 204 may be provided and selected for the different size cables 110. The use of the floor shim 204 enhances the electrical performance of the system by providing an impedance matching function as well as providing electrical shielding.

Figure 8:
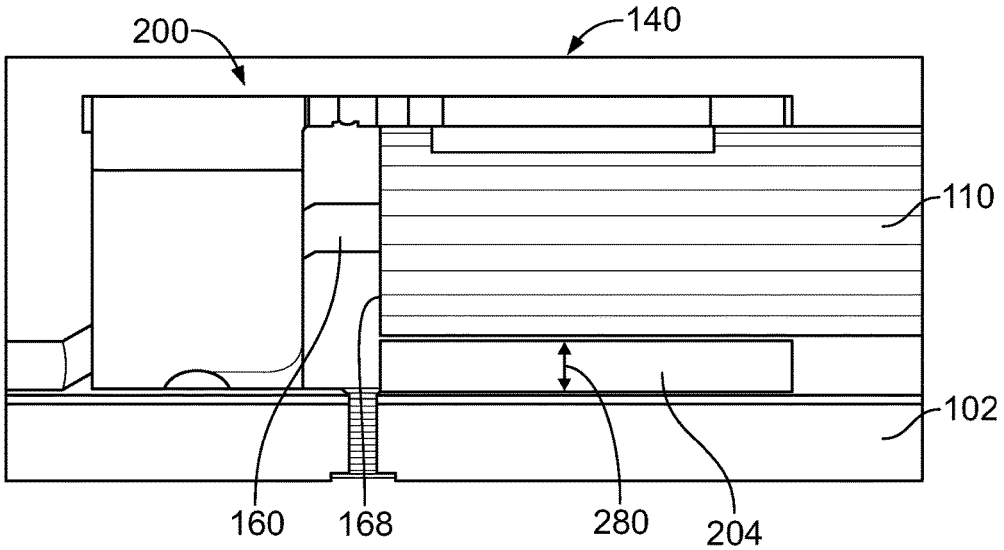
FIG. 8 is a side view of a portion of the electrical assembly in accordance with an exemplary embodiment showing the cable and the cable shield tunnel terminated to the circuit card.

FIG. 8 is a side view of a portion of the electrical assembly 140 in accordance with an exemplary embodiment showing the cable 110 and the cable shield tunnel 200 terminated to the circuit card 102. Comparison of the embodiment illustrated in FIG. 8 with the embodiment illustrated in FIG. 6, the embodiment shown in FIG. 8 provides a shortened floor shim 204. The floor shim 204 shown in FIG. 8 extends rearward of the end 168 of the cable 110. The floor shim 204 does not extend forward of the end 168 of the cable 110, as did the embodiment shown in FIG. 6. Rather, the front end of the floor shim 204 is generally flush with the end 168 of the cable 110. In alternative embodiments, the end 168 of the cable 110 may be positioned forward of the front end of the floor shim 204. The thickness 280 of the floor shim 204 shown in FIG. 8 is greater than the thickness 280 of the floor shim 204 shown in FIG. 6. As such, the floor shim 204 shown in FIG. 8 elevates the cable 110 to a higher position within the cable shield tunnel 200.

Figure 9:
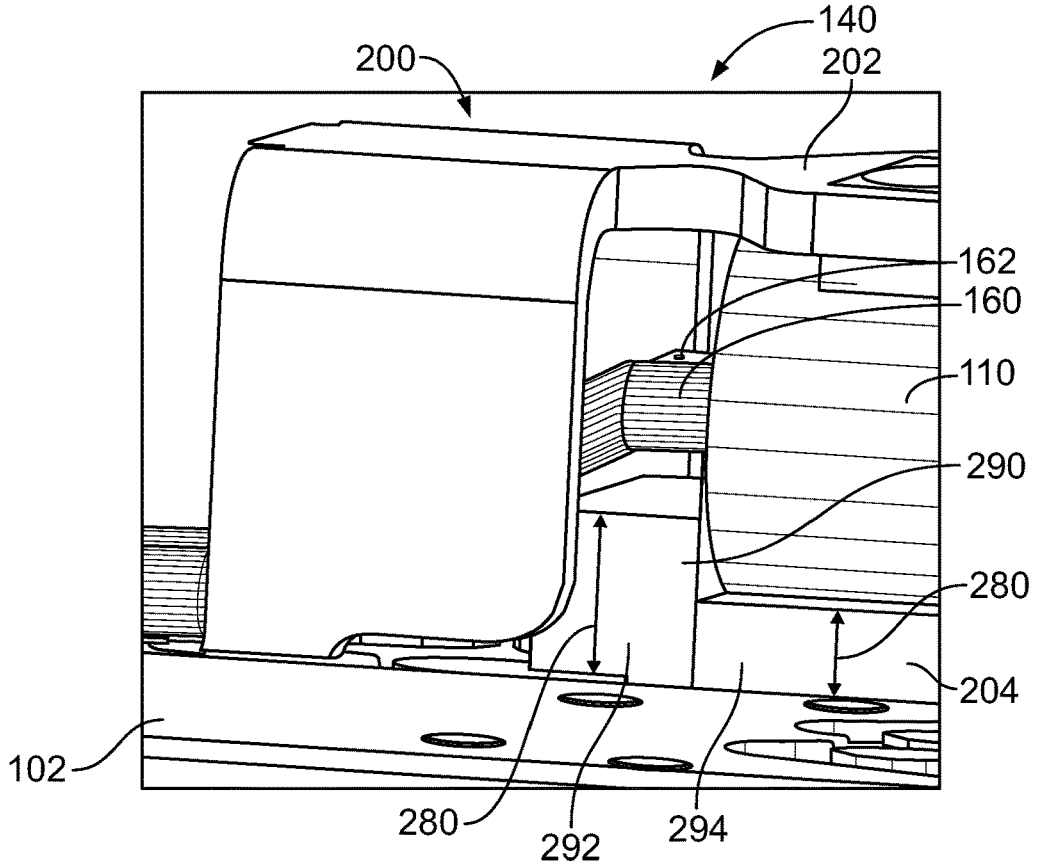
FIG. 9 is a perspective view of a portion of the electrical assembly in accordance with an exemplary embodiment showing the cable and the cable shield tunnel terminated to the circuit card.

FIG. 9 is a perspective view of a portion of the electrical assembly 140 in accordance with an exemplary embodiment showing the cable 110 and the cable shield tunnel 200 terminated to the circuit card 102. Comparison of the embodiment illustrated in FIG. 9 with the embodiment illustrated in FIG. 6, the embodiment shown in FIG. 9 includes a floor shim 204 having a raised section 290. The raised section 290 is provided at a front section 292 of the floor shim 204. The thickness 280 at the raised section 290 is greater than the thickness 280 at a rear section 294 of the floor shim 204. However, the thickness 280 of the floor shim 204 at the rear section 294 controls the positioning (for example, elevation) of the cable 110.

The raised section 290 positions the floor shim 204 closer to the signal conductors 160, 162, thus affecting the electrical characteristics of the system. For example, positioning the raised section 290 of the floor shim 204 closer to the signal conductors 160, 162 lowers impedance of the signal transmission lines as the signal conductors 160, 162 transition from the cable core to the circuit card 102.

Figure 10:
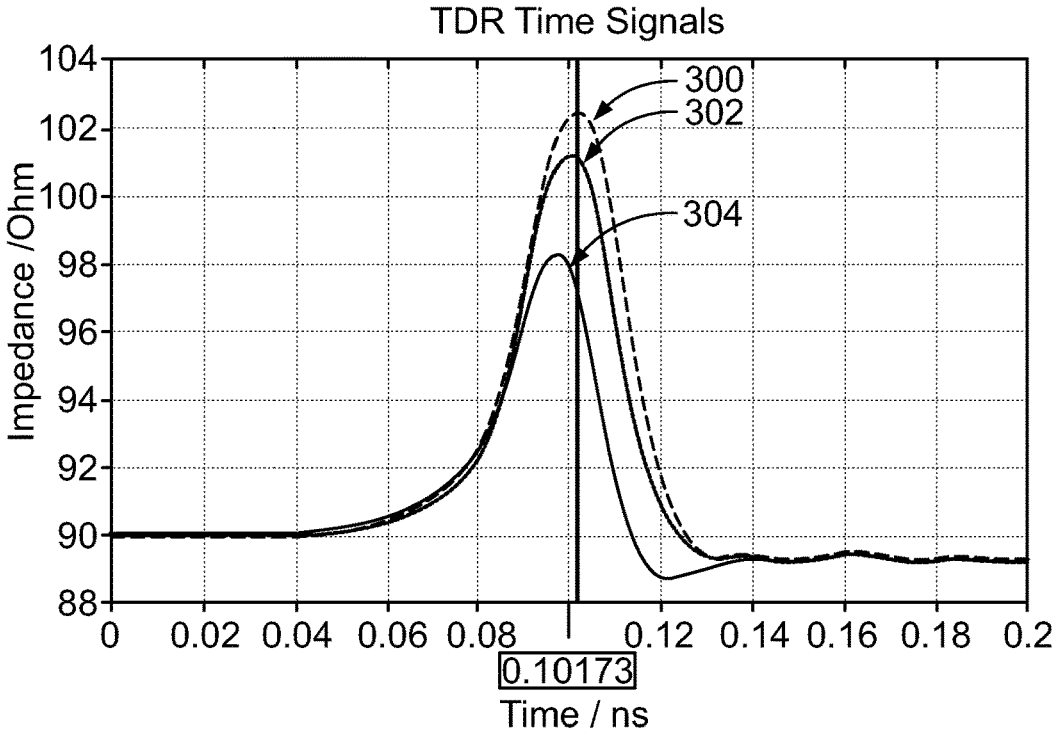
FIG. 10 is a chart showing electrical performance of different embodiments of the electrical device, such as the embodiments shown in FIGS. 6, 8 and 9.

FIG. 10 is a chart showing electrical performance of different embodiments of the electrical device, such as the embodiments shown in FIGS. 6, 8 and 9. The signal transmission lines experience a spike in impedance as the signal transitions from the cable core of the cable for connection to the circuit card. The impedance increase is due to the change in dielectric material surrounding the signal conductors as well as the spacing between the signal conductors and the shielding structure. The chart shows a first line 300 corresponding to the embodiment shown in FIG. 8, a second line 302 corresponding to the embodiment shown in FIG. 6, and a third line 304 corresponding to the embodiment shown in FIG. 9. The first line 300 has the largest spike, and thus has the worst performance of the embodiments (however, may be improved from an embodiment that does not use any floor shim). The third line 304 has the smallest spike, and thus the best performance of the embodiments. The second line 302 has improved performance compared to the first line 300 because the floor shim extends forward of the end of the cable and is positioned closer to the signal conductors (compare FIG. 6 to FIG. 8) to more closely couple the signal conductors to the shield structure. The third line 304 has improved performance compared to the second line 302 because the floor shim includes the raised section that extends upward to position closer to the signal conductors (compare FIG. 9 to FIG. 6) and more fully fill the cavity space in the tunnel to more closely couple the signal conductors to the shield structure.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A cable shield tunnel for an electrical device, the cable shield tunnel comprising:

a ground bus and a floor shim configured to be coupled to a circuit card, the ground bus and the floor shim forming a cable tunnel configured to receive an end of a cable;

the ground bus including an end wall extending along a first end of the cable tunnel, a first side wall extending from the end wall along a first side of the cable tunnel, and a second side wall extending from the end wall along a second side of the cable tunnel opposite the first side, the first and second side walls configured to be coupled to the circuit card; and the floor shim discrete from the ground bus, the floor shim having a shim surface configured to be separately coupled to and rest on a mounting surface of the circuit card, the floor shim provided at a second end of the cable tunnel opposite the first end, the floor shim configured to be positioned between the cable and the circuit card.

2. The cable shield tunnel of claim 1, wherein the floor shim elevates the cable off of the circuit card in the cable tunnel.

3. The cable shield tunnel of claim 1, wherein the floor shim is conductive providing electrical shielding along the second end of the cable tunnel.

4. The cable shield tunnel of claim 1, wherein the floor shim is stamped from a metal blank having a thickness.

5. The cable shield tunnel of claim 4, wherein the thickness is selected based on a tunnel height of the cable tunnel defined between the end wall and the circuit card and based on a cable height of the cable to position the cable in the cable tunnel.

6. The cable shield tunnel of claim 4, wherein the thickness is greater than a thickness of the ground bus.

7. The cable shield tunnel of claim 1, wherein the floor shim includes a front portion and a rear portion, the front portion extending forward of the end of the cable, the rear portion located rearward of the end of the cable and positioned between the cable and the circuit card.

8. The cable shield tunnel of claim 7, wherein the front portion has a first thickness and the rear portion has a second thickness, the first thickness being thicker than the second thickness.

9. The cable shield tunnel of claim 1, wherein the floor shim includes a raised section, the cable tunnel having a first tunnel height between the end wall and the floor shim along the raised section and a second tunnel height between the end wall and the floor shim rearward of the raised section, the second tunnel height being greater than the first tunnel height.

10. The cable shield tunnel of claim 1, wherein the first and second side walls are positioned forward of the end of the cable, the end wall extending both forward and rearward of the end of the cable.

11. The cable shield tunnel of claim 10, wherein the floor shim extends both forward and rearward of the end of the cable.

12. The cable shield tunnel of claim 1, wherein the end wall includes a solder tab configured to be soldered to an outer conductor of the cable.

13. An electrical device comprising:

a circuit card having a cable end, the circuit card having cable contacts along a mounting surface of the circuit card at the cable end;

a cable terminated to the mounting surface of the circuit card at the cable end, the cable having an inner signal conductor and an outer conductor providing electrical shielding for the inner signal conductor, the inner signal conductor terminated to the corresponding cable contact; and a cable shield tunnel coupled to the circuit card at the mounting surface, the cable shield tunnel including a ground bus and a floor shim forming a cable tunnel configured to receive an end of the cable, the ground bus including an end wall extending along a first end of the cable tunnel, a first side wall extending from the end wall along a first side of the cable tunnel, and a second side wall extending from the end wall along a second side of the cable tunnel opposite the first side, the first and second side walls coupled to the mounting surface of the circuit card, the floor shim having a shim surface being separately coupled to and resting on the mounting surface of the circuit card, the floor shim provided at a second end of the cable tunnel opposite the first end, the floor shim positioned between the cable and the circuit card.

14. The electrical device of claim 13, wherein the floor shim elevates the cable off of the circuit card in the cable tunnel.

15. The electrical device of claim 13, wherein the floor shim has a thickness, the thickness being selected based on a tunnel height of the cable tunnel defined between the end wall and the circuit card and based on a cable height of the cable to position the cable in the cable tunnel.

16. The electrical device of claim 13, wherein the floor shim includes a front portion and a rear portion, the front portion extending forward of the end of the cable, the rear portion located rearward of the end of the cable and positioned between the cable and the circuit card.

17. The electrical device of claim 13, wherein the floor shim includes a raised section, the cable tunnel having a first tunnel height between the end wall and the floor shim along the raised section and a second tunnel height between the end wall and the floor shim rearward of the raised section, the second tunnel height being greater than the first tunnel height.

18. An electrical device comprising:

a circuit card having a cable end, the circuit card having cable contacts along a mounting surface of the circuit card at the cable end;

a cable terminated to the mounting surface of the circuit card at the cable end, the cable having an inner signal conductor and an outer conductor providing electrical shielding for the inner signal conductor, the inner signal conductor terminated to the corresponding cable contact, an end of the cable having a cable height; and a cable shield tunnel coupled to the circuit card at the mounting surface, the cable shield tunnel including a ground bus and a floor shim forming a cable tunnel configured to receive the end of the cable, the ground bus including an end wall extending along a first end of the cable tunnel, a first side wall extending from the end wall along a first side of the cable tunnel, and a second side wall extending from the end wall along a second side of the cable tunnel opposite the first side, the first and second side walls coupled to the mounting surface of the circuit card to position the end wall a tunnel height from the mounting surface of the circuit card, the floor shim having a shim surface being separately coupled to and resting on the mounting surface of the circuit card, the floor shim provided at a second end of the cable tunnel opposite the first end, the floor shim positioned between the cable and the circuit card, the floor shim having a thickness selected based on the tunnel height and the cable height.

19. The electrical device of claim 13, wherein the floor shim includes a front portion and a rear portion, the front portion extending forward of the end of the cable, the rear portion located rearward of the end of the cable and positioned between the cable and the circuit card.

20. The electrical device of claim 13, wherein the floor shim includes a raised section, the cable tunnel having a first tunnel height between the end wall and the floor shim along the raised section and a second tunnel height between the end wall and the floor shim rearward of the raised section, the second tunnel height being greater than the first tunnel height.

* * * * *